US010828919B2

(12) United States Patent
Uematsu

(10) Patent No.: US 10,828,919 B2
(45) **Date of Patent: *Nov. 10, 2020**

(54) PRINTER AND METHOD FOR ACCURATELY RECOGNIZING POSITIONS OF LABELS

(71) Applicant: TOSHIBA TEC KABUSHIKI KAISHA, Tokyo (JP)

(72) Inventor: Kaoru Uematsu, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/563,995

(22) Filed: Sep. 9, 2019

(65) Prior Publication Data

US 2020/0001632 A1 Jan. 2, 2020

Related U.S. Application Data

(63) Continuation of application No. 16/111,416, filed on Aug. 24, 2018, now Pat. No. 10,449,790.

(30) Foreign Application Priority Data

Sep. 8, 2017 (JP) ..... 2017-173442

(51) Int. Cl.

| | |
|---|---|
| ***B41J 13/00*** | (2006.01) |
| ***B41J 3/407*** | (2006.01) |
| ***B41J 11/00*** | (2006.01) |

(52) U.S. Cl.

CPC ..... *B41J 13/0009* (2013.01); *B41J 3/4075* (2013.01); *B41J 11/0095* (2013.01)

(58) Field of Classification Search

CPC ..... B41J 11/0095; B41J 3/4075; B41J 29/38; B41J 11/663; B41J 11/46; B41J 13/0009; B65C 9/42; B65C 9/08

(58) Field of Classification Search

USPC ..... 347/14, 16, 104

See application file for complete search history.

(56) References Cited

U.S. PATENT DOCUMENTS

| | | | | |
|---|---|---|---|---|
| 9,656,486 | B2 | 5/2017 | Kanda | |
| 10,449,790 | B2 * | 10/2019 | Uematsu | B41J 13/0009 |
| 2018/0009249 | A1 | 1/2018 | Katsumata | |

FOREIGN PATENT DOCUMENTS

| | | |
|---|---|---|
| JP | 2001-180632 | 7/2001 |
| JP | 2013-216040 | 10/2013 |

* cited by examiner

*Primary Examiner* — Jannelle M Lebron

(74) *Attorney, Agent, or Firm* — Amin, Turocy & Watson, LLP

(57) ABSTRACT

A printer comprises a conveyance section configured to convey labels which are attached to a belt-like mount at predetermined gaps along a longitudinal direction of the mount; a printing section, configured to perform printing on the label; a detection section configured to detect light passing through the mount and the label and to perform output in which the increase and decrease in an amount of transmitted light are reflected; and a recognition section configured to recognize edges of the label by setting a position where the amount of transmitted light increases as a beginning of the gap and setting a position where the amount of transmitted light decreases as an end of the gap, and pretermit a trough between an increasing portion and a decreasing portion adjacent to each other when the increase and the decrease in the amount of transmitted light are repeated in a short conveyance interval.

20 Claims, 6 Drawing Sheets

PRINTER AND METHOD FOR ACCURATELY RECOGNIZING POSITIONS OF LABELS

CROSS-REFERENCE TO RELATED APPLICATIONS

This application is a Continuation of application Ser. No. 16/111,416 filed on Aug. 24, 2018, the entire contents of which are incorporated herein by reference.

This application is based upon and claims the benefit of priority from Japanese Patent Application No. P2017-173442, filed Sep. 8, 2017, the entire contents of which are incorporated herein by reference.

FIELD

Embodiments described herein relate generally to a printer and a method for accurately recognizing positions of labels.

BACKGROUND

A conventional printer performs printing on a label. A plurality of labels, which is a piece of paper having an adhesion layer on a surface opposite to a printing surface, adheres to a belt-like mount at substantially fixed intervals (gaps), and a label roll obtained by winding the mount attached with labels is placed in a paper feed section of the printer.

The printing surface of the label and the mount alternatively appear at a printing position of the printer during conveyance of a label roll. The printer needs to confirm the position of the label on the label roll to perform printing at a correct position. For example, an optical sensor is used to confirm the position of the label. The printer determines a boundary between the label and the gap from an increase and/or decrease in an amount of light (amount of transmitted light) penetrating the label and/or the mount.

However, there are often perforations at a portion between adjacent labels on the mount. The perforations are continuous small holes formed on the mount to make subsequent separation of labels easy. In the printer which confirms the position of the label by the above method, when a label roll having perforations is used, since the amount of transmitted light is low at the perforation, there is a case in which the position of a perforation is mistaken as the boundary between the gap and the label. In this case, since the printer recognizes the position of the label erroneously, the accuracy of the printing position is low.

DETAILED DESCRIPTION

In accordance with an embodiment, a printer comprises a conveyance section configured to convey labels which are attached to a belt-like mount at predetermined gaps along a longitudinal direction of the mount; a printing section, arranged on a conveyance path of the label conveyed by the conveyance section, configured to perform printing on the label; a detection section configured to detect light passing through the mount and the label attached to mount and to perform output in which the increase and decrease in an amount of transmitted light along with conveyance of the mount and the label are reflected; and a recognition section configured to recognize edges of the label by setting a position where the amount of transmitted light increases as a beginning of the gap and setting a position where the amount of transmitted light decreases as an end of the gap based on the output of the detection section, and to pretermit a trough between an increasing portion and a decreasing portion adjacent to each other when the increase and the decrease in the amount of transmitted light are repeated in a short conveyance interval shorter than a predetermined value.

Figure 1:
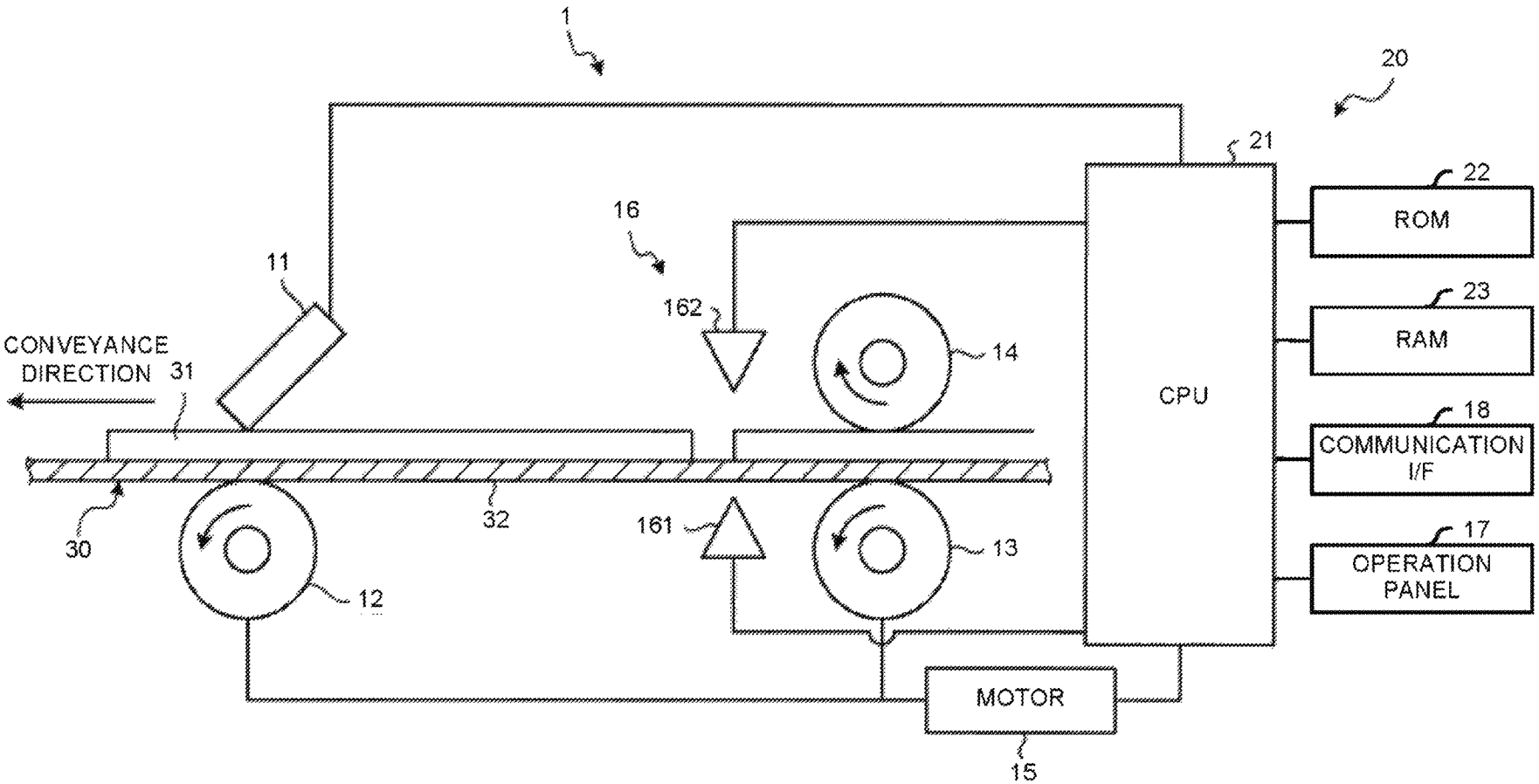
FIG. 1 is a diagram illustrating a configuration of a printer according to an embodiment.

Hereinafter, an embodiment is described with reference to the accompanying drawings. FIG. 1 is a diagram illustrating a configuration of a printer 1 according to the embodiment. The printer 1 first includes a print head 11, a platen roller 12, a conveyance roller 13, a pressure roller 14, a motor 15, an optical sensor 16, an operation panel 17, a communication I/F (interface) 18, a CPU (Central Processing Unit) 21, a ROM (Read Only Memory) 22, and a RAM (Random Access Memory) 23.

The CPU 21, the ROM 22, and the RAM 23 constitute a controller 20. The ROM 22 stores various programs to be executed by the CPU 21 and various data. The RAM 23 temporarily stores data and programs when the CPU 21 executes various programs. By executing various programs, the CPU 21 collectively controls each section of the printer 1.

Figure 2:
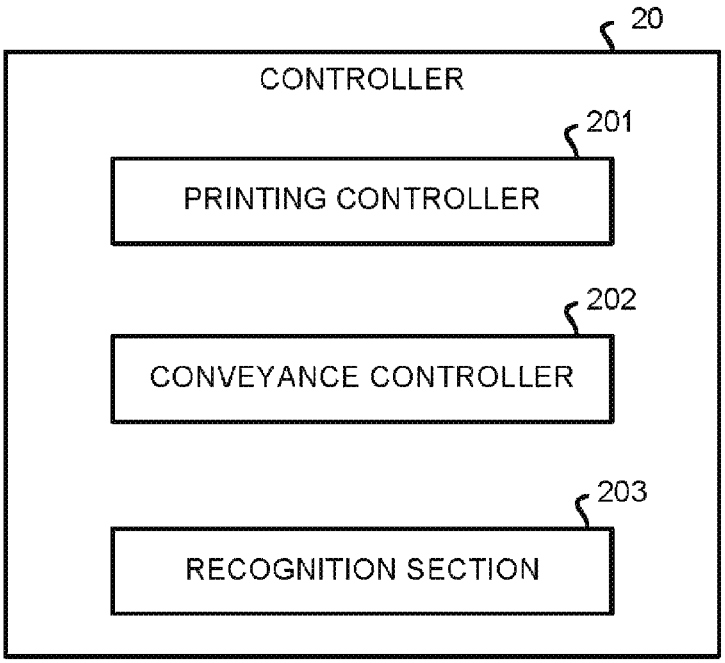
FIG. 2 is a block diagram illustrating functional sections implemented by a controller.

FIG. 2 is a block diagram illustrating functional sections implemented by the controller 20. The controller 20 functions as a printing controller 201, a conveyance controller 202, and a recognition section 203 by the CPU 21 executing programs. The operation of each functional section is described later.

A label paper is denoted by reference numeral 30. In the label paper 30, a plurality of labels 31, which is a scrap of paper having an adhesion layer on a surface opposite to the printing surface, is attached to a belt-like mount 32 at substantially fixed intervals (gaps). The label 31 of the present embodiment has a thermosensitive color developing layer on the printing surface.

For example, the motor 15, which is a stepping motor, issues a driving force for rotating the platen roller 12 and the conveyance roller 13 in response to a control pulse received from the controller 20 (the printing controller 201 and the conveyance controller 202).

The conveyance roller 13 and the pressure roller 14 constitute a conveyance section for conveying the label paper 30 along a longitudinal direction of the label paper 30. The pressure roller 14 sandwiches the label paper 30 between the conveyance roller 13 and the pressure roller 14 to press the label paper 30 towards the conveyance roller 13. The conveyance roller 13 conveys the label paper 30 between the conveyance roller 13 and the pressure roller 14 by rotating. The conveyance controller 202 described above controls conveyance of the label paper 30 by controlling the conveyance section (the conveyance roller 13 and the pressure roller 14) and the motor 15.

The print head 11 and the platen roller 12 constitute a printing section which is provided on a conveyance path of the label 31 and performs printing on the label 31. The print head 11 is, for example, a line thermal head in which a plurality of heat generation elements is provided side by side. The heat generation element generates heat to heat the thermosensitive color developing layer of the label 31 to enable the thermosensitive color developing layer to develop color. The platen roller 12 conveys the label paper 30 by rotating. The print head 11 and the platen roller 12 in the printing section cooperate with each other to perform printing on the label 31. The printing controller 201 described above controls printing by controlling the print head 11, the platen roller 12 and the motor 15.

The operation panel 17 includes various keys, a display section, and the like, and receives various operations by an operator. The communication I/F 18 is connected with a host device or the like via a communication line. The host device is, for example, a PC (Personal Computer) and sends a label issuing job to the printer 1. The label issuing job includes data relating to printing contents such as characters and marks printed on the label 31, a barcode, and the like. The label issuing job is stored in the RAM 23 to be held until the execution of the job is completed.

The optical sensor 16, which is an example of a detection section, detects light passing through the label paper 30, and performs an output in which increase and decrease in an amount of transmitted light accompanying conveyance of the label paper 30 are reflected. More specifically, the optical sensor 16 is a transmission sensor including a light emitting section 161 and a light receiving section 162. The light emitting section 161 emits light towards the label 31 and the mount 32. The light receiving section 162 receives the light emitted by the light emitting section 161 and then passing through the label 31 and the mount 32, and outputs an electric signal that changes in accordance with the amount (amount of transmitted light) of the received light.

Figure 3:
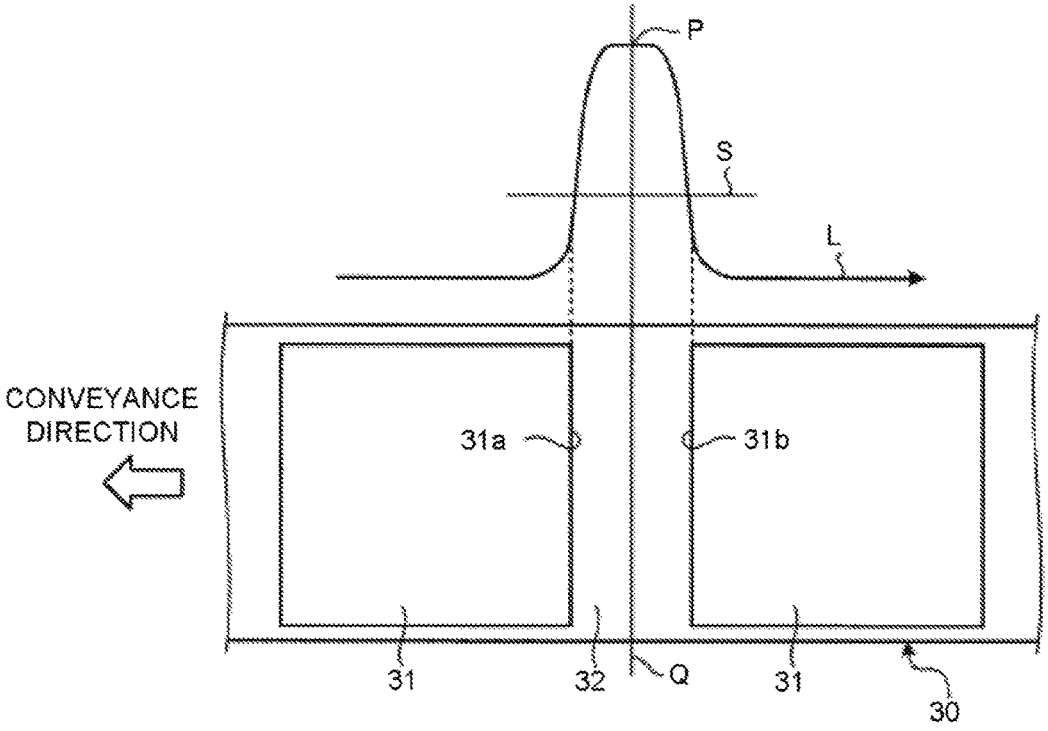
FIG. 3 is a diagram illustrating a correspondence relationship between a waveform illustrating an output of an optical sensor as a graph and positions of a mount and a label.

FIG. 3 is a diagram illustrating a correspondence relationship between a waveform of an output L from the optical sensor 16 which is indicated in a graph form and the positions of the mount 32 and the label 31. The output L from the optical sensor 16 indicates the increase and decrease in the amount of transmitted light. The output L increases at a rear end 31*a* of the label 31 and decreases at a front end 31*b* of the label 31. Furthermore, the output L takes the maximum value at a central portion Q of a portion (i.e., the gap) where only the mount 32 exists when there is no perforation in the mount 32. A protruding portion including the maximum value is hereinafter referred to as a peak P of the output L.

In FIG. 3, a threshold value S (threshold value) is donated with a numeral reference S. The threshold value S is used by the recognition section 203 of the controller 20 to recognize the edge of the label 31. The recognition section 203 recognizes the position of the label 31 based on the output L from the optical sensor 16 due to the fact that the amount of the transmitted light rapidly increases at a position where the label 31 changes to the mount 32 and rapidly decreases at a position where the mount 32 changes to the label 31.

The recognition section 203 determines the position where the output L increases to exceed the threshold value S as the rear end 31*a* of the label 31, and determines the position where the output L decreases to be lower than the threshold value S as the front end 31*b* of the label 31. The rear end 31*a* of the label 31 is the beginning of the gap, and the front end 31*b* of the label 31 is the end of the gap.

If the above determination is described with reference to the graph shown in FIG. 3, the recognition section 203 determines that the position corresponding to an intersection of the waveform of the output L in which the amount of transmitted light is increasing and the threshold value S is the beginning of the gap. The recognition section 203 determines that the position corresponding to the intersection of the output L in which the amount of transmitted light is decreasing and the threshold value S is the end of the gap. Thus, the recognition section 203 recognizes the edge of the label 31 and distinguishes the label 31 and the mount 32.

Here, the threshold value S may be a fixed value or a variable value. When the printer 1 uses an automatic calibration function, the threshold value S is set to the variable value. The printer 1 automatically sets the threshold value S based on the output L from the optical sensor 16 by executing an automatic calibration operation. The automatic calibration operation is executed when the printer 1 does not have a size of the label 31 or the gap, when the printer 1 does not use the size of the label 31 or the gap, or when the given size of the gap is roughly approximate and the reliability thereof is low.

The variable value of the threshold value S is determined by the following method, for example. The recognition section 203 sets a value corresponding to a location where the change (increase or decrease) of the output L is significant in the automatic calibration operation as the threshold value S. In particular, the printer 1 records the output L from the optical sensor 16 each time the conveyance is performed in response to a pulse applied to the motor 15. When a difference of the recorded values of the output L is large to a predetermined extent (i.e., significant), the recognition section 203 sets an intermediate value of the recorded values as the threshold value S. In other words, when there is a change exceeding the predetermined difference $\alpha$ in the amount of transmitted light while the label paper 30 is being conveyed, the recognition section 203 calculates the amount of transmitted light of the center of a conveyance interval, and sets the calculated value as the threshold value S. As the difference $\alpha$, an appropriate value is previously determined as a difference between the amount of transmitted light of a portion where the label 31 and the mount 32 overlap with each other and the amount of transmitted light of a portion where only the mount 32 exits.

Figure 4:
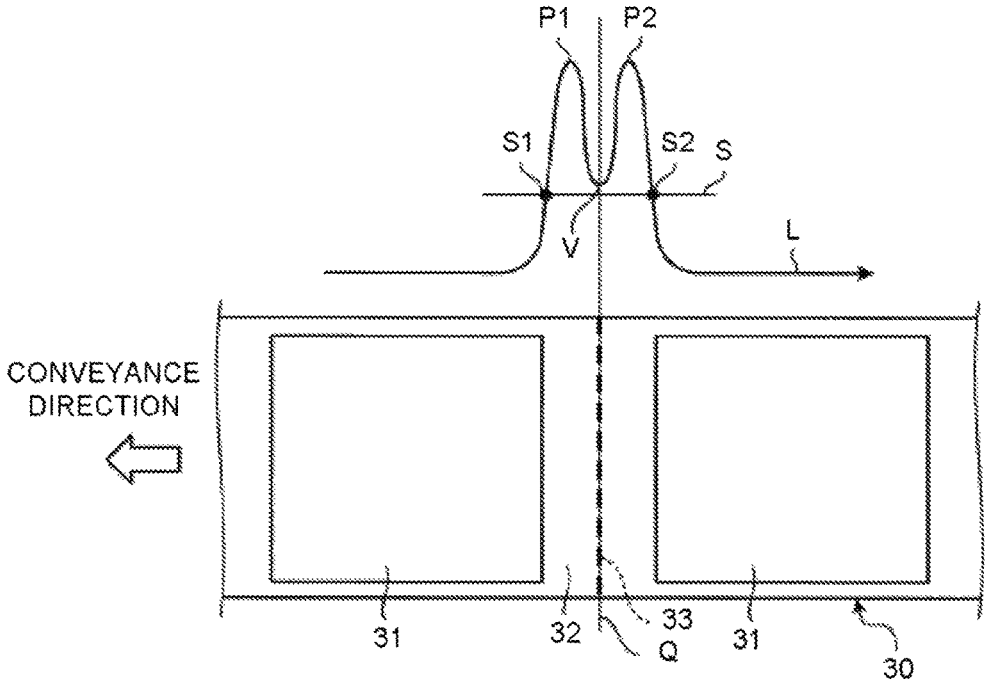
FIG. 4 is a diagram illustrating the output of the optical sensor when the mount has perforations.
Figure 5:
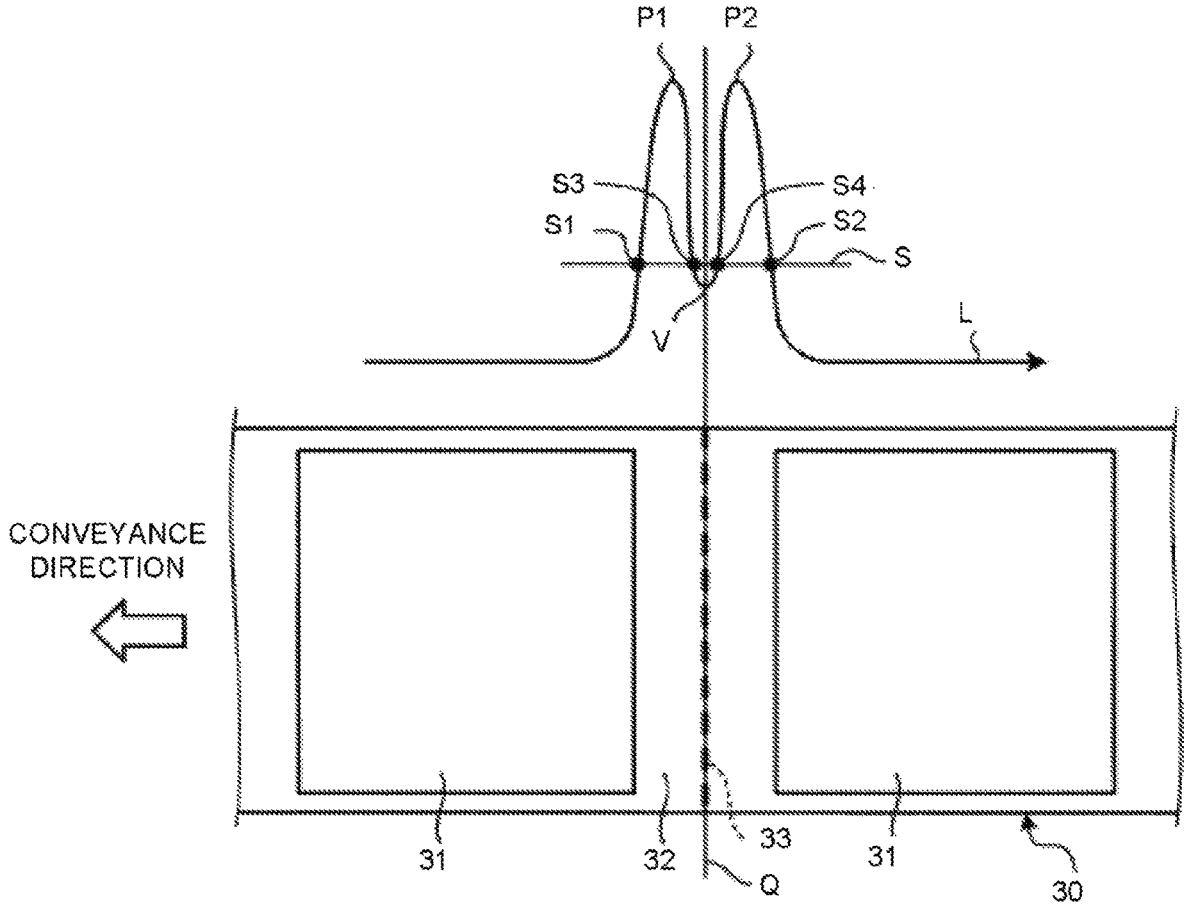
FIG. 5 is a view illustrating the output of the optical sensor when the mount has perforations.

FIG. 4 and FIG. 5 are diagrams illustrating the output L from the optical sensor 16 if the mount 32 has perforations 33. The perforations 33 are continuous small holes for facilitating separation and are formed on the mount 32 along a width direction of the mount 32. The perforations 33 are formed at the central portion Q of the gap.

When the perforations 33 are formed on the mount 32, the amount of transmitted light decreases at the perforations 33, and thus, the output L corresponding to that position decreases to become a trough V. As the trough V is formed in the output L, the peak P which is a complete one in the case of no perforation as shown in FIG. 3 is divided into two to form adjacent peaks P1 and P2 sandwiching the trough V, and the above adjacent peaks P1 and P2 continuously appear in the output L. The trough V is formed by a decreasing portion of the peak P1 and an increasing portion of the adjacent peak P2.

FIG. 4 shows a case in which the trough V of the output L does not fall below the threshold value S. FIG. 5 shows a case in which the trough V of the output L falls below the threshold value S.

Even if the trough V occurs, if the trough V does not fall below the threshold value S as shown in FIG. 4, only the increasing point S1 and the decreasing point S2 are recognized by the recognition section 203 as the boundaries between the label 31 and the mount 32. Therefore, in this case, even when the conventional control method is used, the gap can be recognized without problems. However, in a case in which the trough V shown in FIG. 5 is below the threshold value S, if the conventional control method is used, a decreasing point S3 and an increasing point S4 contained in the trough V are erroneously recognized as the boundaries between the label 31 and the mount 32 in addition to the above-mentioned points S1 and S2, resulting in inaccurate recognition of the gap.

Therefore, the recognition section 203 of the present embodiment can pretermit the trough V between the adjacent peaks P1 and P2 if the increase and decrease of the amount of transmitted light repeatedly appear in a section corresponding to a short conveyance distance that is less than a predetermined value.

The recognition section 203 of the present embodiment pretermits the trough V if the conveyance distance of the portion corresponding to the trough V is smaller than a value β which is an example of a first value. The value β is predetermined, for example, based on a size γ (2 mm, for example) in the conveyance direction of the trough V corresponding to the perforations 33. The value β is, for example, equal to the size γ (i.e., the size γ may be the first value). In practice, for example, a value slightly larger (smaller) than the size γ may be set as the value β by reflecting the trend of the optical sensor 16 in the value β. An appropriate value as a size in the conveyance direction of the trough V corresponding to the perforations 33 is previously determined as the size γ.

By taking a portion from the top of the peak P1 to the top of the peak P2 through decreasing and increasing as the trough V, the recognition section 203 calculates a conveyance distance δ of this portion. Subsequently, if the conveyance distance δ is smaller than the value β, the recognition section 203 recognizes that there is no trough V, and the peaks P1 and P2 are continuous. In other words, the waveform of the output L is continuous from the top of the peak P1 to the top of the peak P2.

According to this method, the printer 1 of the present embodiment accurately recognizes the gap even if the trough V takes a value lower than the threshold value S, thereby ensuring the accuracy of the printing position.

Figure 6:
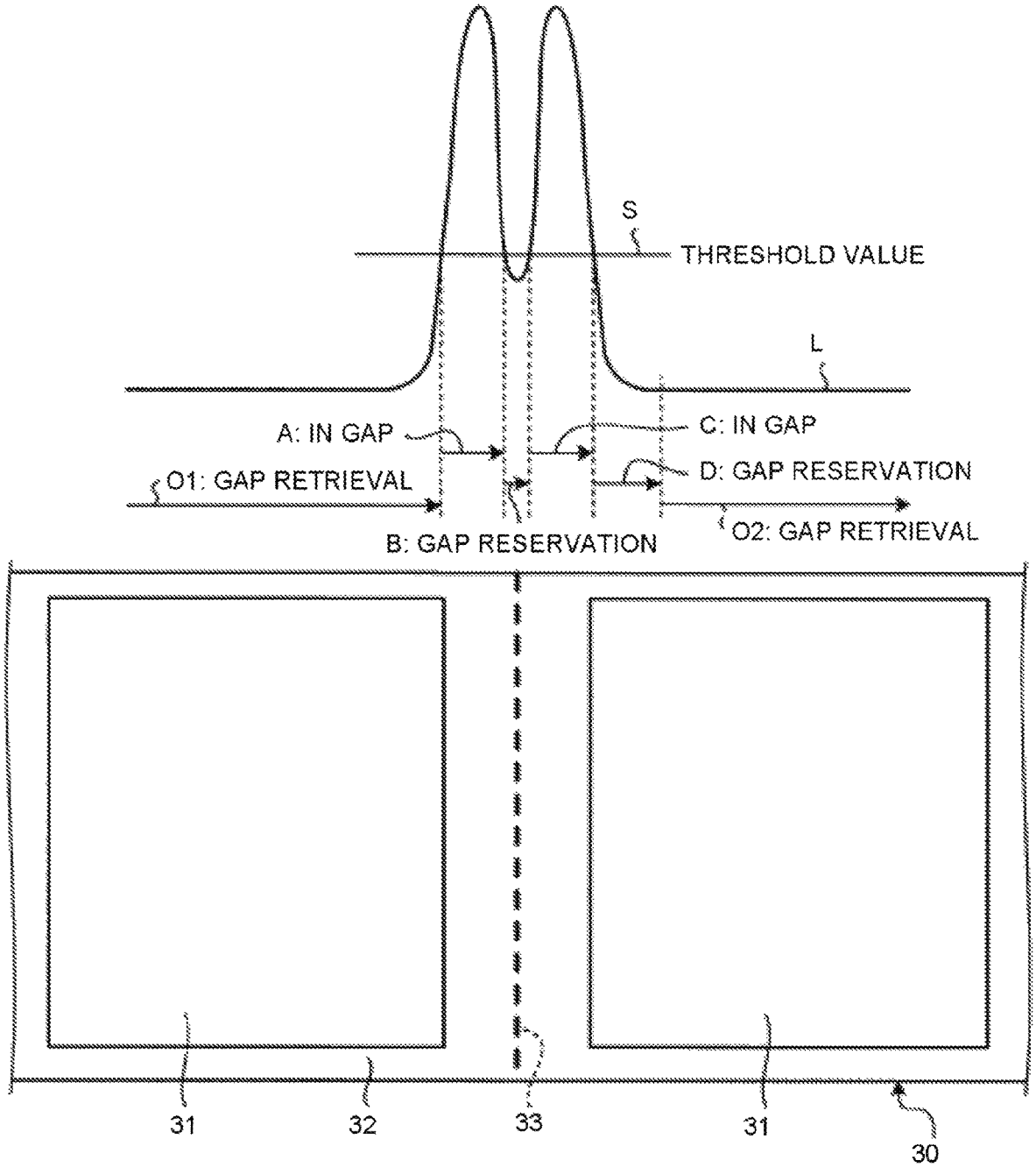
FIG. 6 is a diagram illustrating a method of estimating positions of the mount and the label from the output of the optical sensor.
Figure 7:
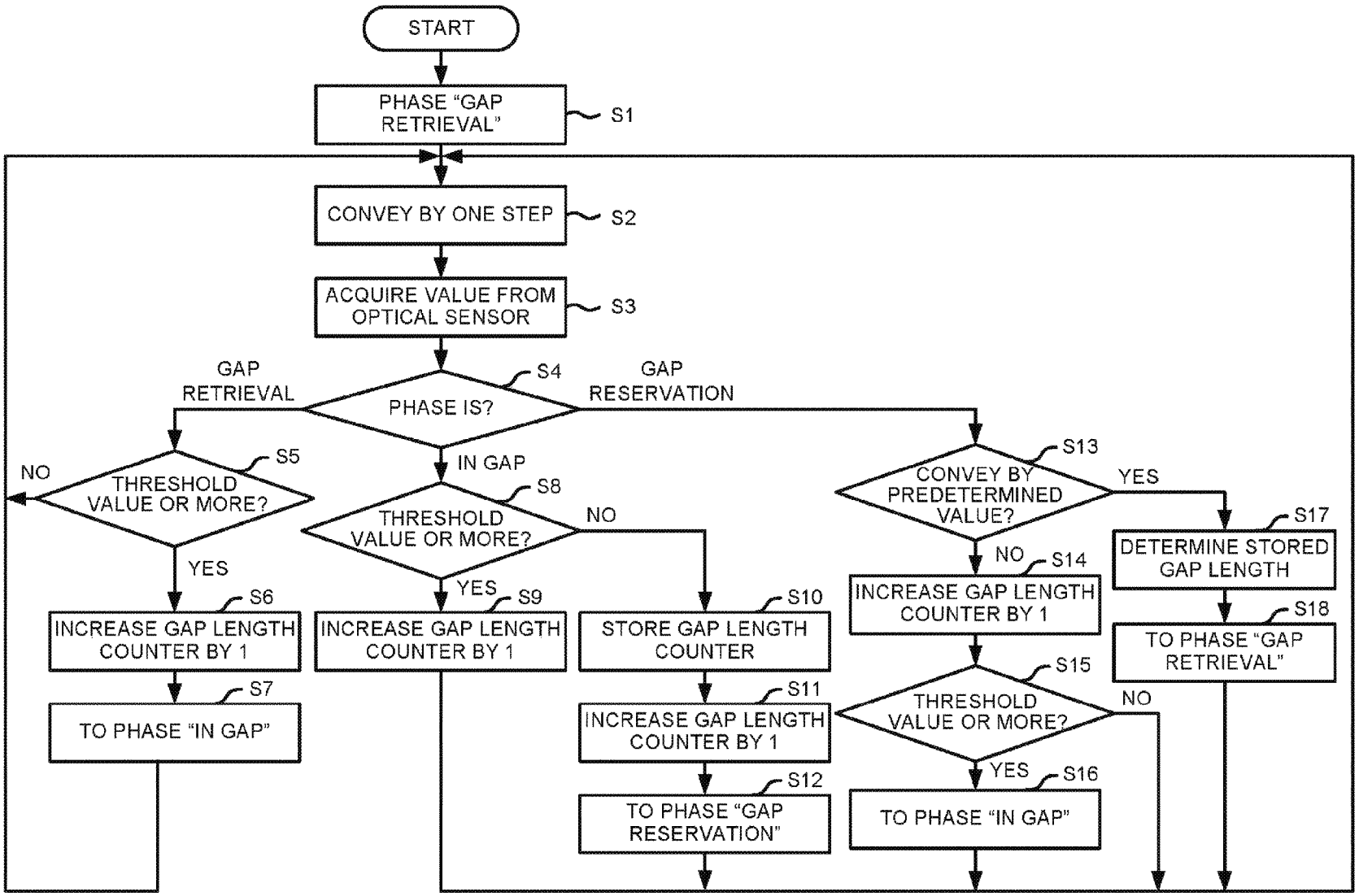
FIG. 7 is a flowchart schematically depicting a flow of a processing performed by the controller.

Estimation of the position of the label 31 in the printer 1 configured as described above is described below with reference to FIG. 6 and FIG. 7. FIG. 6 is a diagram illustrating a method for estimating the positions of the mount 32 and the label 31 from the output L from the optical sensor 16. FIG. 7 is a flowchart schematically depicting the flow of a processing performed by the controller 20.

In processing phases performed by the controller 20, there is "gap retrieval" indicated by reference numerals O1 and O2, "in gap" indicated by reference numerals A and C, and "gap reservation" indicated by reference numerals B and D, which are shown in FIG. 6.

The controller 20 first enters a phase of the "gap retrieval" (Act S1), functions as the conveyance controller 202 to apply a pulse to the motor 15, and conveys the label paper 30 by one step (Act S2). Subsequently, the controller 20 functions as the recognition section 203 to acquire the value output by the optical sensor 16 and store it in the RAM 23 (Act S3). The output L shown by the waveform in FIG. 6 is a graph showing the value acquired in Act S3. The output L at this time point is a part up to the gap retrieval O1.

In the following Act S4, the controller 20 confirms the processing phase. In Act S4, if the phase is "gap retrieval", the controller 20 proceeds to the processing in Act S5, and functions as the recognition section 203 to determine whether the output L is equal to or greater than the threshold value S. If the output L is not equal to or greater than the threshold value S in Act S5 (No in Act S5), the controller 20 returns to the processing in Act S2. The output L at this time point is the part up to the gap retrieval O1 still.

In Act S5, if the output L is equal to or greater than the threshold value S (Yes in Act S5), the controller 20 proceeds to the processing in Act S6 and increases the gap length counter (increased by 1). The output L at this time point is a part which is going to enter the in gap A.

Here, the gap length counter is counted from the time point when the output L enters the in gap A from the gap retrieval O1. Since a count value of this gap length counter corresponds to the number of pulses applied to the motor 15 in Act S2, the conveyance distance and the length of the gap can be calculated based on the count value.

In Act S7 subsequent to Act S6, the controller 20 changes the processing phase to "in gap" and returns to the processing in Act S2.

In Act S4, if the phase is "in gap", the output L at this time point is the in gap A or C. First, a case in which the output L is the in gap A is described. In this case, the controller 20 proceeds to the processing in Act S8, and functions as the recognition section 203 to determine whether the output L is equal to or greater than the threshold value S. If the output L is equal to or greater than the threshold value S in the Act S8 (Yes in the Act S8), the output L continuously corresponds to in gap A, and thus, the controller 20 proceeds to the processing in Act S9 to increase the gap length counter, and then returns to the processing in Act S2.

If the output L is not equal to or greater than the threshold value S in Act S8 (No in Act S8), since the output L changes from the in gap A to the gap reservation B, the controller 20 proceeds to the processing in Act S10 to store the gap length counter.

Here, when the label paper 30 is not perforated, the value calculated based on the gap length counter stored in Act S10 is set as a determined value of the length of the gap in Act S17 described later.

The output L in Act S10 corresponds to the gap reservation B. After Act S10, the controller 20 increases the gap length counter in Act S11, changes the processing phase to "gap reservation" in the next Act S12, and then returns to the processing in Act S2.

In Act S4, if the phase is "gap reservation", the output L at this time point is the gap reservation B or D. First, a case in which the output L is the gap reservation B is described. In this case, the controller 20 proceeds to the processing in Act S13, and functions as the recognition section 203 to determine whether the conveyance distance after the output L enters the gap reservation B is equal to or greater than the value β.

Here, as described above, the value β is determined based on the size in the conveyance direction of the trough V corresponding to the perforations 33, and corresponds to a conveyance distance in a range in which the perforations 33 affect the output L. Therefore, when the output L is the gap reservation B corresponding to the trough V, the determination in Act S13 is No.

The conveyance distance can be calculated from the difference between the value of the gap length counter at that time point and the gap length counter stored in Act S10. Although the value β and the conveyance distance are compared here, in practice, the count value corresponding to the value β and the value of the gap length counter may be compared.

If the determination in Act S13 is No, the controller 20 proceeds to the processing in Act S14 to increase the gap length counter, and then determines whether the output L is equal to or greater than the threshold value S in Act S15. If the output L is not equal to or greater than the threshold value S in Act S15 (No in Act S15), the controller 20 returns to the processing in Act S2. The output L at this time point is still the gap reservation B.

In Act S15, if the output L is equal to or greater than the threshold value S (Yes in Act S15), the output L at this time point is in gap C. In this case, the controller 20 proceeds to the processing in Act S16, changes the processing phase to "in gap", and returns to the processing in Act S2.

In a case in which the output L is in gap C, the output L at the time point when the processing phase is changed from Act S4 to the "gap reservation" phase after Acts S8 to S12 is the gap reservation D.

Here, the count value of the gap length counter stored in Act S10 in the case of the in gap C corresponds to the conveyance distance from a boundary position between the gap retrieval O1 and the in gap A of the output L to a boundary position between the in gap C and the gap reservation D, i.e., the gap length. As described above, even if the gap includes the gap reservation B, according to the processing of the present embodiment, the gap length can be measured based on the output L.

In Act S4, if the output L is the gap reservation D, the controller 20 proceeds to the processing in Act S13. In this case, the conveyance distance does not exceed the above-mentioned value β, and the output L is not equal to or greater than the threshold value S. In other words, in the case of the gap reservation D, the controller 20 does not perform the processing in Act S16 after the determination of Yes in Act S15.

If the output L is the gap reservation D, the controller 20 determines Yes in Act S13 after the loop of No in Act S13, Act S14, No in Act S15, and Act S2 to Act S4. In other words, when the conveyance distance is equal to or greater than the value β, the controller 20 proceeds to the processing in Act S17, calculates the length of the gap based on the gap length counter stored in Act S10, and sets the calculated value as the determined value. Then, the controller 20 proceeds to the processing in Act S18, changes the processing phase to "gap retrieval", and returns to the processing in Act S2. The output L at this time point is the gap retrieval O2.

As described above, according to the printer 1 of the present embodiment, the boundary between the label 31 and the gap can be correctly recognized even if the perforations 33 are formed on the mount 32 of the label 31. As a result, it is possible to improve the accuracy of the printing position.

As in the present embodiment, the predetermined value β is used based on the size γ in the conveyance direction of the trough V corresponding to the perforations 33, and within a section corresponding to the value β, if the amount of transmitted light increases after decreasing, it is considered that the trough between the adjacent peaks is generated due to the perforations 33, and in this way, even if the size of the gap varies, it is possible to obtain the correct gap by eliminating the trough V generated due to the perforations 33.

In the present embodiment, when the trough V does not fall below the threshold value S as shown in FIG. 4, even if the output L becomes the gap reservation B, the determination in Act S8 is No (the output L is less than the threshold value S) and the processing phase remains in the in gap until the output L is no longer the in gap C after the gap reservation B.

In other words, the recognition section 203 of the present embodiment pretermits the trough V when the amount of transmitted light at the bottom of the trough V is equal to or greater than the threshold value S, and thus, the gap can be recognized correctly and the accuracy of the printing position can be improved.

In the present embodiment, the recognition section 203 excludes the influence of the trough V in the above example, but in practice, the embodiment is not limited to the above example, and the recognition section 203 can solve the problem by pretermitting the trough between the adjacent increasing portions and the decreasing portions when the increase and the decrease in the amount of transmitted light are repeated in a short conveyance interval shorter than a predetermined value.

(Modification)

In the above embodiment, a case in which the threshold value S is a variable value is described, but it may be a fixed value in practice.

The threshold value S which is the fixed value is determined according to the characteristics of the label paper 30. For example, experimentally the label paper 30 is conveyed, the output L from the optical sensor 16 at that time is recorded, and the threshold value S is determined based on the recorded output L. If the threshold value S is the fixed value, the threshold value S may be adjusted in such a manner that it is set to a low value so that the trough V caused by the perforations 33 is not recognized.

If the threshold value S is the fixed value, the trough V appearing in a period of time in which the conveyance distance exceeds the "second value" after the output L exceeds the threshold value S is pretermitted. Thus, the problem can be solved. The second value is predefined based on a standard value of the gap in the label paper 30 to be used.

The program to be executed by the printer 1 in the embodiment is incorporated in the ROM 22 or the like in advance to be provided.

The program to be executed by the printer 1 in the embodiment may be provided by being recorded in a computer-readable recording medium such as a CD-ROM, a FD (Flexible Disk), a CD-R, a DVD (Digital Versatile Disk) or the like in a file in an installable format or an executable format.

Furthermore, the program to be executed by the printer 1 of the embodiment may be provided by being stored in the computer connected to the network such as the Internet, and then being downloaded via the network. Furthermore, the program to be executed by the printer 1 in the embodiment may be provided or distributed via a network such as the Internet.

The program to be executed in the printer 1 of the embodiment has a module configuration including the above-described sections (the printing controller 201, the conveyance controller 202, and the recognition section 203). The CPU (processor) 21 reads out the program from the storage medium and executes it, thereby loading the above sections on the main storage device. As a result, the printing controller 201, the conveyance controller 202, and the recognition section 203 are generated on the main storage device.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A printer, comprising:

a conveyance section configured to convey labels which are attached to a belt-like mount at predetermined gaps along a longitudinal direction of the mount;

a printing section, arranged on a conveyance path of the label conveyed by the conveyance section, configured to perform printing on the label;

a light emitting section configured to emit light towards the mount and the label attached to mount;

a light receiving section configured to receive the light emitted by the light emitting section and perform output in which an increase and a decrease in an amount of light with conveyance of the mount and the label; and a controller to configured to recognize edges of the label by setting a position based on the output of the light receiving section; and pretermit a trough between an increasing portion and a decreasing portion adjacent to each other when the increase and the decrease in the amount of light received by the light receiving section are repeated in a short conveyance interval shorter than a predetermined value.

2. The printer according to claim 1, wherein the controller pretermits the trough when a conveyance distance of a portion corresponding to the trough is smaller than a predetermined first value.

3. The printer according to claim 2, wherein the first value is determined based on a size along a conveyance direction of the trough corresponding to perforations formed on the mount in a width direction of the mount.

4. The printer according to claim 1, wherein the controller pretermits the trough appearing in a period until conveyance distances of the mount and the label are equal to or greater than a second value predetermined based on a reference value of the gap after receiving the increase in the amount of light received by the light receiving section.

5. The printer according to claim 1, wherein the controller pretermits the trough when the amount of light received by the light receiving section at the bottom of the trough is equal to or greater than a predetermined threshold value.

6. The printer according to claim 1, wherein a conveyance distance of a portion corresponding to the trough is smaller than a length of the label.

7. The printer according to claim 1, wherein a length of the gap is smaller than a length of the label.

8. A method of accurately recognize positions of labels by a printer, comprising:

conveying labels attached to a belt-like mount at predetermined gaps along a longitudinal direction of the mount for printing on the label;

emitting light towards the mount and the labels attached to mount;

receiving the light emitted and performing output in which an increase and a decrease in an amount of light with conveyance of the mount and the labels;

recognizing edges of the labels by setting a position where an amount of light received increases as a beginning of a gap and setting a position where the amount of light received decreases as an end of the gap based on the output in which the increase and decrease in the amount of light received along with conveyance of the mount and the labels; and pretermitting a trough between an increasing portion and a decreasing portion adjacent to each other when the increase and the decrease in the amount of light received are repeated in a short conveyance interval shorter than a predetermined value.

9. The method according to claim 8, further comprising:

printing on the labels.

10. The method according to claim 8, further comprising:

printing on the labels without printing on the mount.

11. The method according to claim 8, wherein pretermitting the trough when a conveyance distance of a portion corresponding to the trough is smaller than a predetermined first value.

12. The method according to claim 11, wherein the first value is determined based on a size along a conveyance direction of the trough corresponding to perforations formed on the mount in a width direction of the mount.

13. The method according to claim 8, wherein pretermitting the trough appearing in a period until conveyance distances of the mount and the labels are equal to or greater than a second value predetermined based on a reference value of the gap after detecting the increase in the amount of transmitted light.

14. The method according to claim 8, wherein pretermitting the trough when the amount of transmitted light at the bottom of the trough is equal to or greater than a predetermined threshold value.

15. A method of detecting perforations, comprising:

conveying labels which are attached to a belt-like mount at predetermined gaps along a longitudinal direction of the mount;

emitting light towards the mount and the labels attached to mount;

receiving the light emitted and performing output in which an increase and a decrease in an amount of light with conveyance of the mount and the labels;

recognizing edges of the labels by setting a position where the amount of light received increases as a beginning of a gap and setting a position where the amount of light received decreases as an end of the gap; and detecting perforations by pretermitting a trough between an increasing portion and a decreasing portion adjacent to each other when the increase and the decrease in the amount of light received are repeated in a short conveyance interval shorter than a predetermined value.

16. The method according to claim 15, further comprising:

printing on the labels without printing on the mount.

17. The method according to claim 15, wherein pretermitting the trough when a conveyance distance of a portion corresponding to the trough is smaller than a predetermined first value.

18. The method according to claim 17, wherein the first value is determined based on a size along a conveyance direction of the trough corresponding to perforations formed on the mount in a width direction of the mount.

19. The method according to claim 15, wherein pretermitting the trough appearing in a period until conveyance distances of the mount and the label are equal to or greater than a second value predetermined based on a reference value of the gap after detecting the increase in the amount of light received.

20. The method according to claim 15, wherein pretermitting the trough when the amount of light received at the bottom of the trough is equal to or greater than a predetermined threshold value.

* * * * *